US007999165B2

(12) United States Patent
Chen

(10) Patent No.: US 7,999,165 B2
(45) **Date of Patent: *Aug. 16, 2011**

(54) PEDAL SYSTEM AND A DRUM ASSEMBLY USING THE SAME

(76) Inventor: Kuo-Chang Chen, Taichung (TW)

( * ) Notice: Subject to any disclaimer, the term of this patent is extended or adjusted under 35 U.S.C. 154(b) by 0 days.

This patent is subject to a terminal disclaimer.

(21) Appl. No.: 12/613,498

(22) Filed: Nov. 5, 2009

(65) Prior Publication Data

US 2011/0100194 A1 May 5, 2011

(51) Int. Cl.
*G10D 13/08* (2006.01)

(52) U.S. Cl. ..... 84/422.1

(58) Field of Classification Search ..... 84/421, 84/422.1, 422.2, 422.3

See application file for complete search history.

(56) References Cited

U.S. PATENT DOCUMENTS 6,096,958 A * 8/2000 Liao ..... 84/422.3

* cited by examiner

*Primary Examiner* — Kimberly R Lockett

(57) ABSTRACT

A pedal system of the present invention includes a support element, a connecting shank, a fixation element and a transmission element. The support element has a pedal and a rotatable axle. The axle inserts through the connecting shank and the fixation element in a rotational operative relationship. The transmission element connects between the pedal and the connecting shank. The fixation element is adapted for a drum hammer to dispose thereon. The fixation element has a longitudinal slot and a positioning unit. The axle is movable between both ends of the longitudinal slot, and the positioning unit selectively fixes a relative position of the longitudinal slot and the axle. As such, the position of the drum hammer is adjustable for the player to achieve better performance effect.

8 Claims, 8 Drawing Sheets

PEDAL SYSTEM AND A DRUM ASSEMBLY USING THE SAME

BACKGROUND OF THE INVENTION

1. Field of the Invention

The present invention relates to a pedal system for a percussion instrument, and more particularly for a drum.

2. Description of the Prior Art

Some of the conventional drum assemblies include pedal systems for the player to percuss the drum by foot. However, the conventional pedal system is not adapted for different drums with various dimensions. Specifically, the distance between a drum hammer of the pedal system and a drum skin varies case by case, which affects the player's performance.

SUMMARY OF THE INVENTION

The main object of the present invention is to provide a pedal system whose drum hammer is position-adjustable.

To achieve the above and other objects, a pedal system of the present invention includes a support element, a connecting shank, a fixation element and a transmission element. The support element has a pedal and a rotatable axle. The axle inserts through the connecting shank and the fixation element in a rotational operative relationship. The transmission element connects between the pedal and the connecting shank. The fixation element is adapted for a drum hammer to dispose thereon. The fixation element has a longitudinal slot and a positioning unit. The axle is movable between both ends of the longitudinal slot, and the positioning unit selectively fixes a relative position of the longitudinal slot and the axle. As such, the position of the drum hammer is adjustable for the player to achieve better performance effect.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
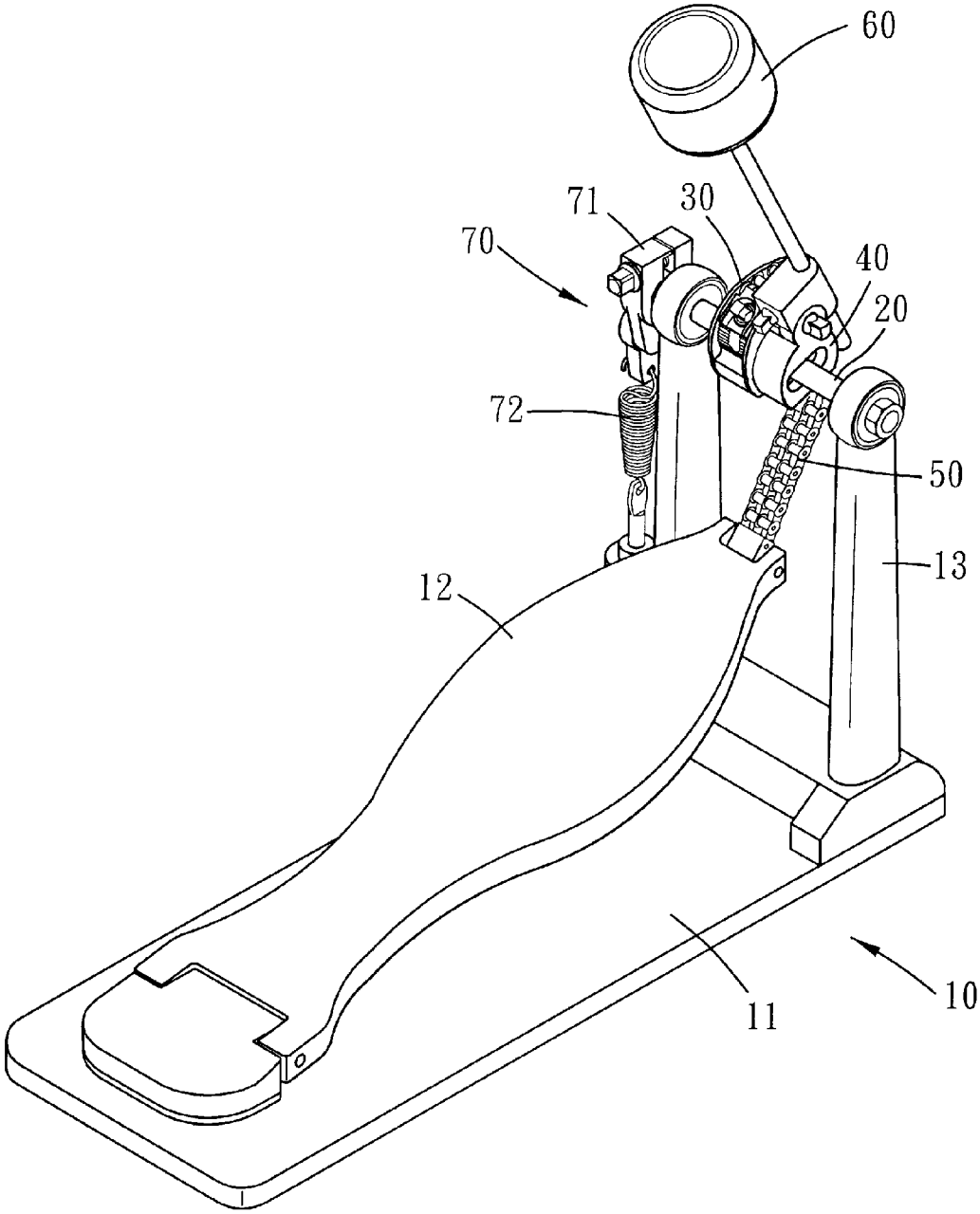
FIG. 1 is a perspective drawing showing a pedal system of the present invention.
Figure 2:
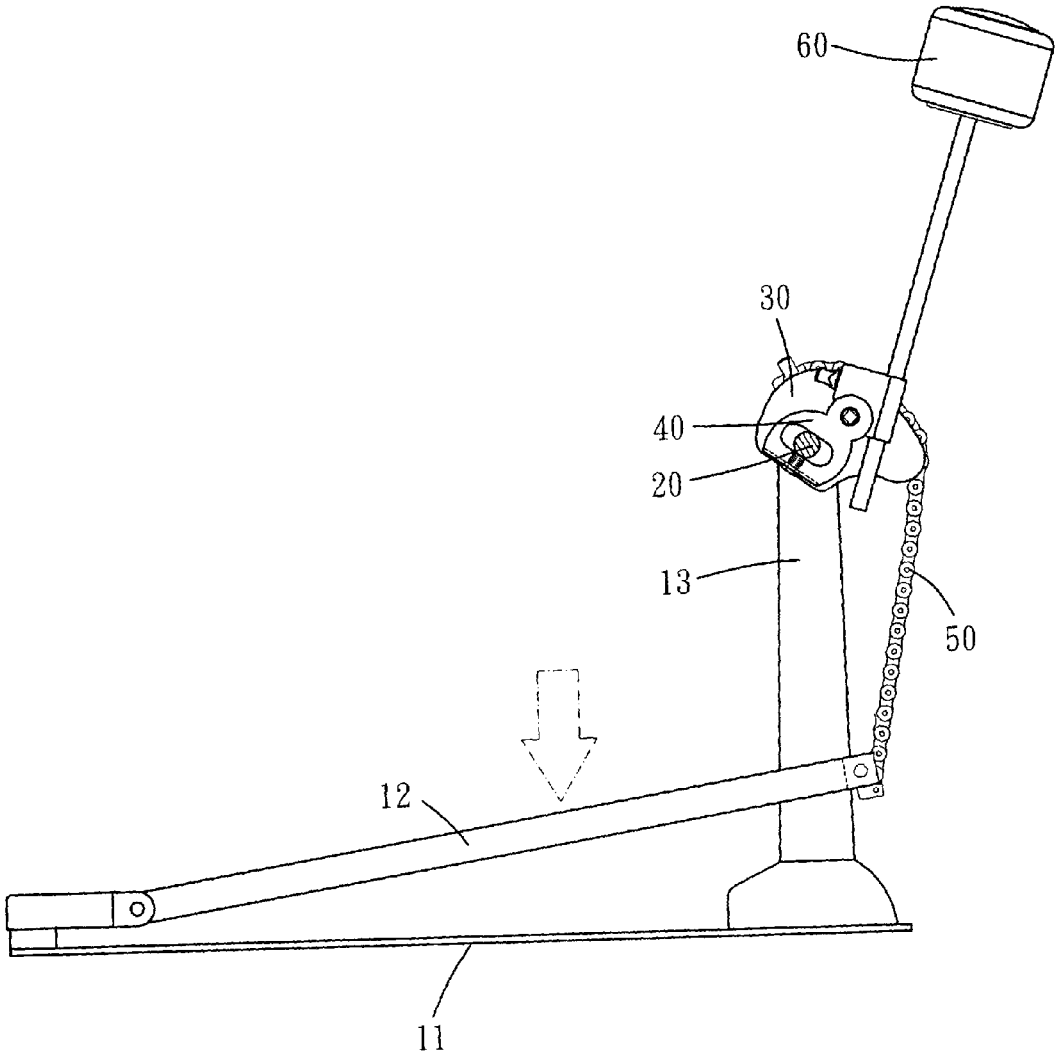
FIG. 2 is a lateral view showing a pedal system, with its pedal at the percussion position, of the present invention.

Please refer to FIG. 1 and FIG. 2. A pedal system of the present invention includes a support element 10. The support element 10 includes a pedal base 11 having a pedal 12 pivotably disposed thereon. As shown in FIG. 1, the pedal 12 locates at a release position when it is not stepped upon. As shown in FIG. 2, the pedal 12 moves to a percussion position when it is stepped upon. Two upright frames 13 are disposed on a side of the pedal base 11, and an axle 20 is rotatably disposed between distal ends of the upright frames 13. Note that the axle 20 can also be supported by a single upright frame. The axle 20 inserts through a connecting shank 30 and a fixation element 40 in a rotational operative relationship, e.g. the axle 20 may have a non-circular profile for the shank 30 and the fixation element 40 to engage therewith.

Figure 3:
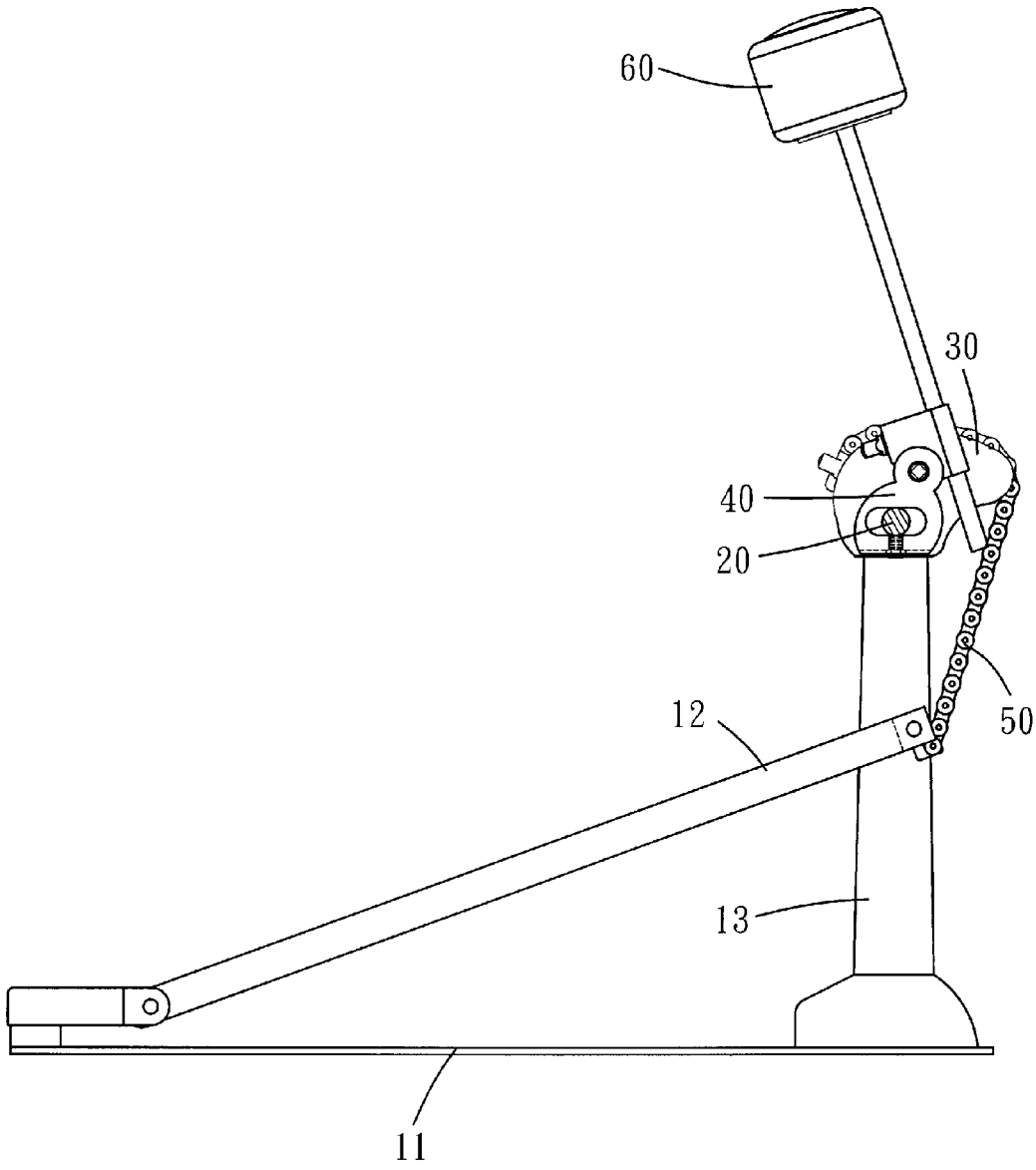
FIG. 3 is a lateral view showing a pedal system, with its pedal at the release position, of the present invention.

Please refer to FIG. 1 and FIG. 3. A transmission element 50 is disposed between the connecting shank 30 and the pedal 12. The transmission element 50 may be a chain 50, as shown in the drawings, a link rod or a belt. Specifically, one end of the transmission element 50 connects to the pedal 12, and another end thereof connects to the shank 30. As such, the stepping force on the pedal 12 can be transmitted by the transmission element 50 to rotate the shank 30, the axle 20 and the fixation element 40.

Figure 4:
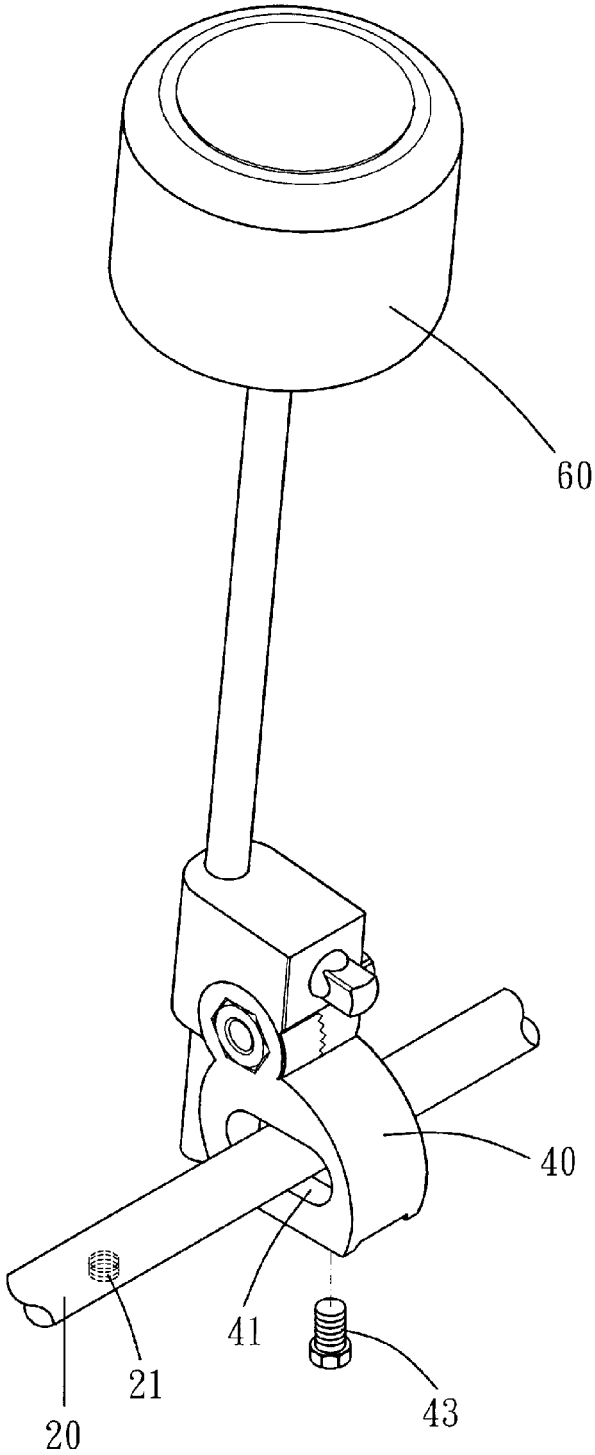
FIG. 4 is an enlarge drawing showing a fixation element of the present invention.
Figure 4A:
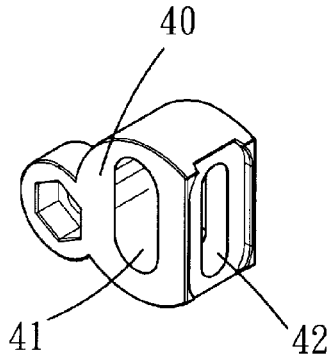
FIG. 4A is a drawing showing a fixation element of the present invention at another angle of view.

Please refer to FIG. 4 and FIG. 4A. The fixation element 40 is adapted for a drum hammer 60 to dispose thereon, and the fixation element 40 has a longitudinal slot 41 for the axle 20 to insert therethrough. The length of the longitudinal slot 41 is bigger than the dimension of the axle 20 so that the axle 20 is movable between a first end and a second end of the slot 41. The fixation element 40 further has a positioning unit including a positioning groove 42 and an engaging element 43. The positioning groove 42 communicates with the slot 41 and extends between the first and second ends of the slot 41. The axle 20, on the other hand, has a threaded bore 21, and the engaging element 43 inserts through the positioning groove 42 and selectively threadedly engages with the bore 21 of the axle 20 to fix the relative position of the longitudinal slot 41 and the axle 20.

Figure 5:
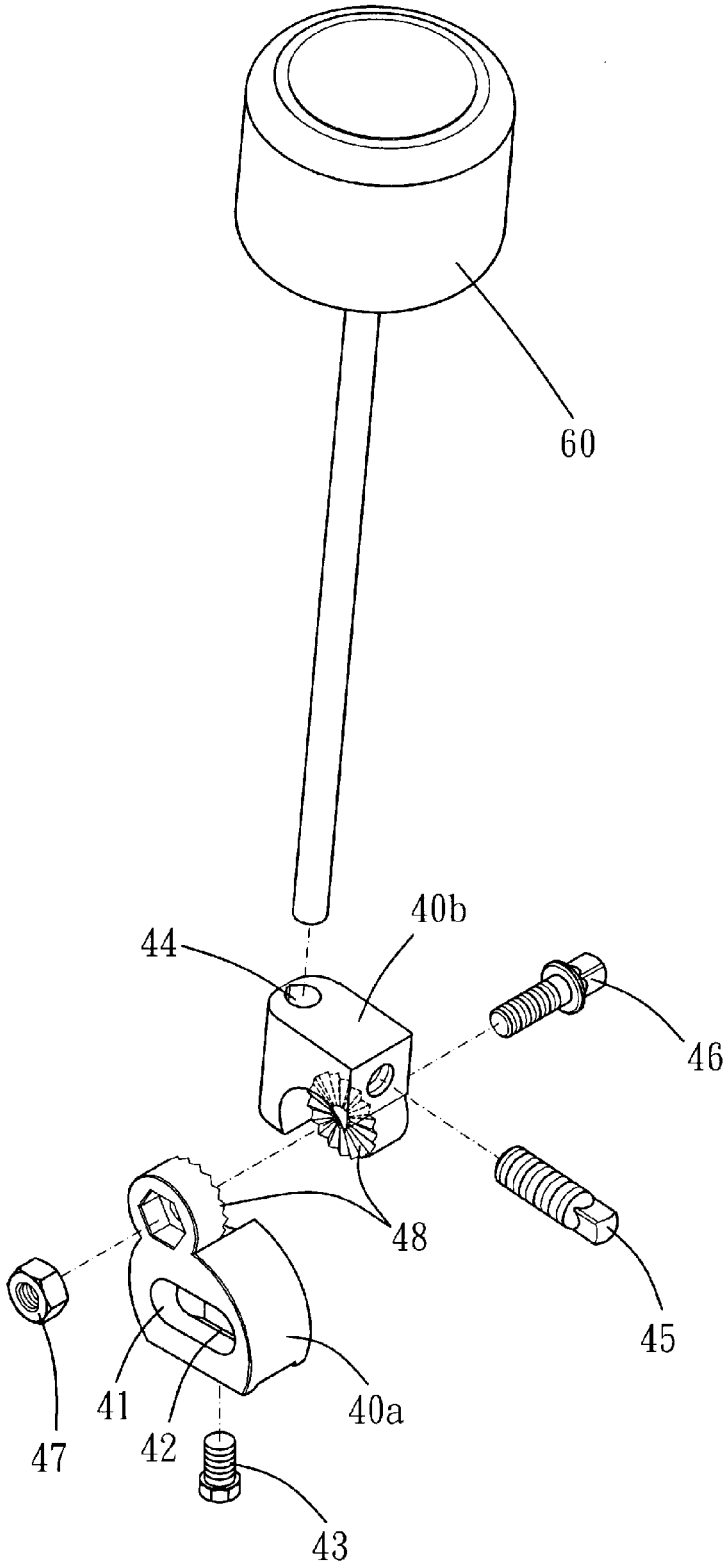
FIG. 5 is a breakdown drawing showing a fixation element of the present invention.

Please refer to FIG. 5. The fixation element 40 further includes a first part 40*a* and a second part 40*b* detachably connected to the first part 40*a*. The longitudinal slot 41 is disposed on the first part 40*a*, and the second part 40*b* has a through hole 44 and an engaging element 45 for the drum hammer 60 to insert through the hole 44 and be fixed by the engaging element 45. An adjusting means is provided to selectively rotating the first part 40*a* about the second part 40*b*. The adjusting means includes an adjusting element having an adjusting axle 46 and a nut 47. The adjusting axle 46 inserts through bores of the first and second parts 40*a* and 40*b* and then engages with the nut 47. As such, the first and second parts 40*a* and 40*b* can rotate about each other and be selectively forced to abut against each other by the adjusting element. Preferably, the first and second parts 40*a* and 40*b* have a teeth plate 48 respectively. Each teeth plate 48 has a plurality of teeth radially arranged thereon, and the bores of the first and second parts 40*a* and 40*b* locate at centers of the teeth plates 48 respectively. As such, the first and second parts 40*a* and 40*b* can not rotate about each other while forced by the adjusting element to abut against each other tightly.

Figure 6:
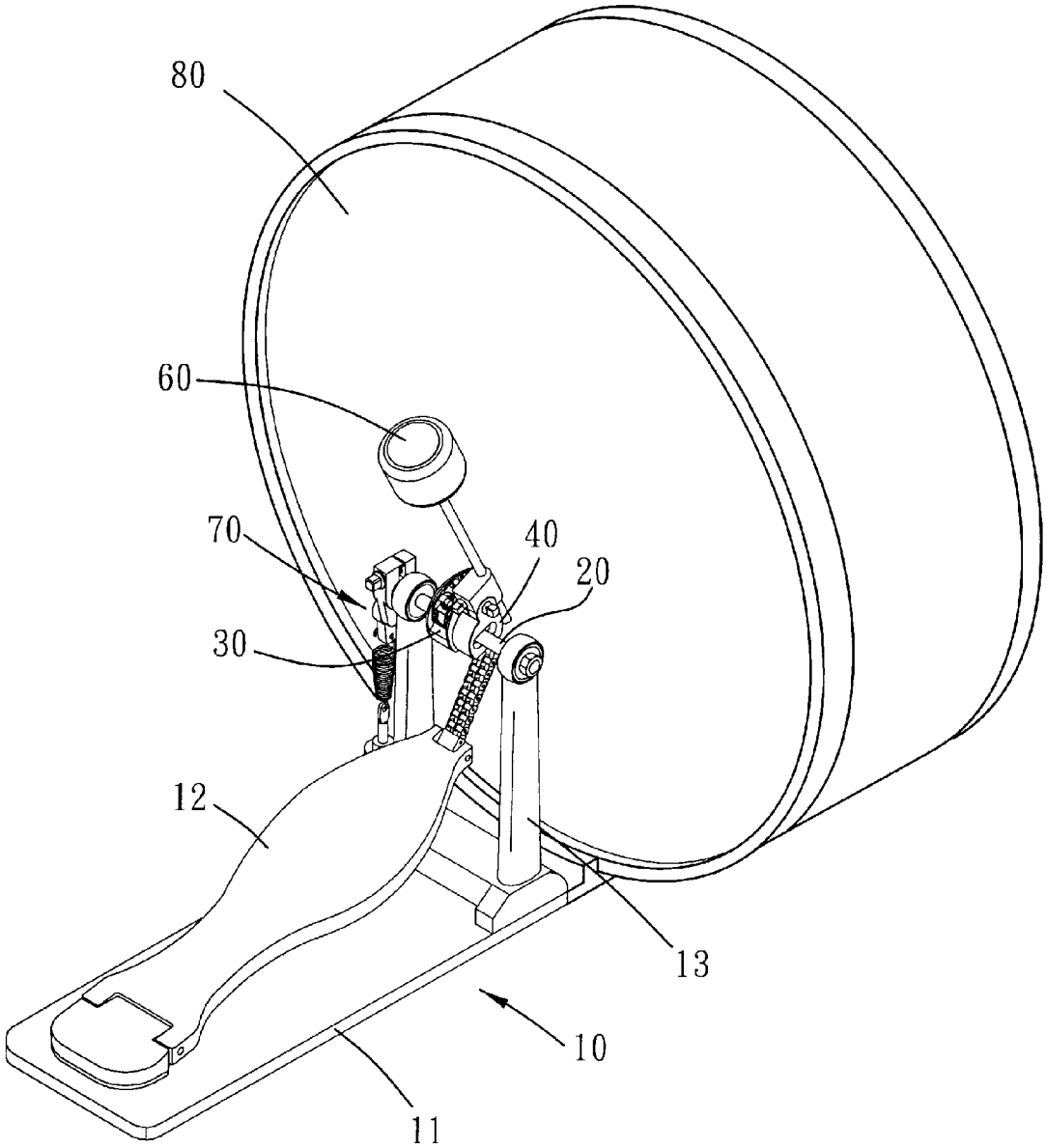
FIG. 6 is a perspective drawing showing a drum assembly of the present invention.

Please refer to FIG. 1 and FIG. 6. A means is provided for returning the pedal 12 back to the release position. The returning means includes a connecting body 71 and a resilient member 72. The connecting body 71 clamps the axle 20 in a rotational operative relationship. The resilient member 72 connects between the connecting body 71 and the support element 10. Thus the resilient member 72 provides a resilient force to retain the axle 20 to a predetermined position, moving the pedal 12 to the release position. Note that it is possible to install the returning means on the connecting shank 30, the fixation element 40, the transmission element 50 or the pedal 12 instead of the axle 20.

Figure 7:
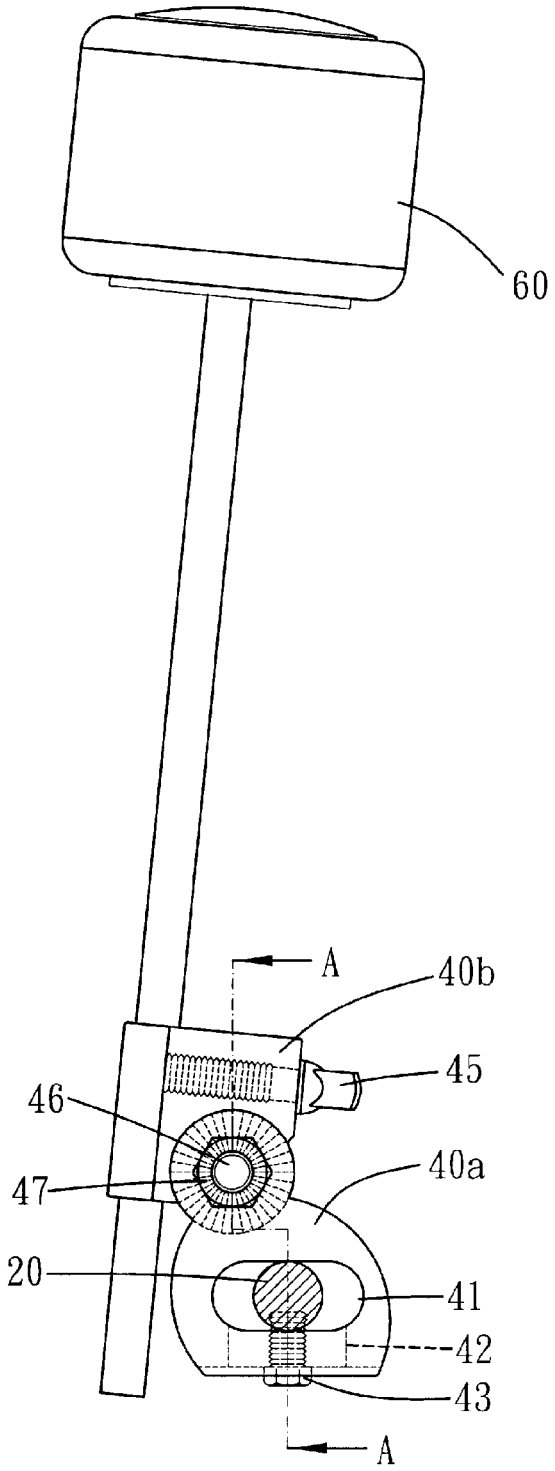
FIG. 7 is a profile showing a fixation element of the present invention.
Figure 7A:
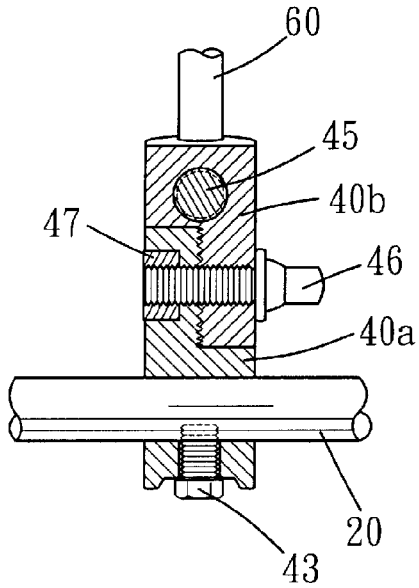
FIG. 7A is an AA profile of FIG. 7.
Figure 8:
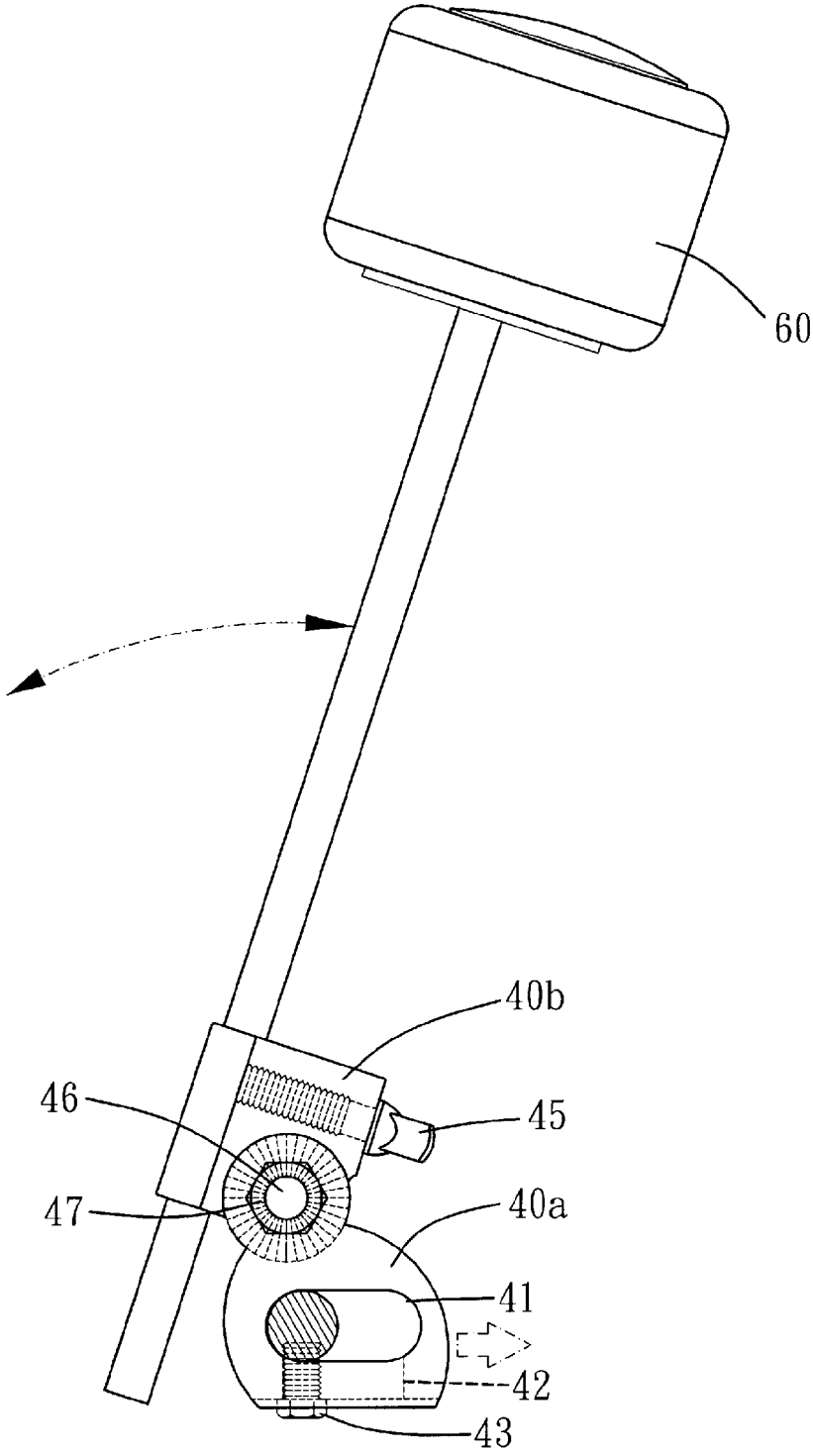
FIG. 8 is a lateral view showing the fixation element.

The pedal system of the present invention can be assembled with a drum. Specifically, the drum 80 has a drum skin for the drum hammer 60 to strike thereupon to make sounds. Please refer to FIG. 7, FIG. 7A and FIG. 8. Since the fixation element 40 is movable with respect to the axle 20, the distance between the hammer 60 and the drum skin is, therefore, adjustable. Also, due to the adjusting means, the elevation angle of the hammer 60 is adjustable as well. As such, the drum assembly can be accurately tuned to meet the player's tendency, so as to achieve a better performance effect.

What is claimed is:

1. A pedal system for a drum, comprising:

a support element, having a pedal and at least one upright frame, the pedal being swayable between a release position and a percussion position, an axle being rotatably disposed on the upright frame;

a connecting shank, disposed on the axle in a rotational operative relationship;

a fixation element, having a longitudinal slot and a positioning unit, the longitudinal slot having a first end and a second end, the axle inserting through the longitudinal slot and being movable between the first and second ends, the positioning unit selectively fixing a relative position of the longitudinal slot and the axle, the fixation element being adapted for a drum hammer to dispose thereon;

a transmission element, connecting between the pedal and the connecting shank, the connecting shank being rotatable as the pedal pivoting between the release position and the percussion position.

2. The pedal system of claim 1, wherein the positioning unit comprises a positioning groove and an engaging element, the positioning groove extends between the first and second ends and communicates with the longitudinal slot, the engaging element inserts through the positioning groove and selectively threadedly engages with the axle to fix the relative position of the longitudinal slot and the axle.

3. The pedal system of claim 1, wherein the fixation element comprises a first part and a second part detachably connected to the first part, the longitudinal slot is disposed on the first part, and the second part is adapted for the drum hammer to disposed thereon; an adjusting means for selectively rotating the first part about the second part.

4. The pedal system of claim 3, wherein the adjusting means comprises an adjusting element having an adjusting axle inserting through bores of the first and second parts for the first and second parts to be respectively rotatable about the adjusting axle, the adjusting element selectively forces the first and second parts to abut against each other.

5. The pedal system of claim 4, wherein the first and second parts have a teeth plate respectively, each teeth plate has a plurality of teeth radially arranged thereon, the bores of the first and second parts locate at centers of the teeth plates respectively.

6. The pedal system of claim 1, further comprising a means for returning the pedal back to the release position.

7. The pedal system of claim 1, wherein a drum hammer is disposed on the fixation element.

8. A drum assembly using the pedal system of claim 7, comprising at least one drum skin for the drum hammer to strike thereupon.

* * * * *